US009587468B2

(12) United States Patent
Greci et al.

(10) Patent No.: US 9,587,468 B2
(45) Date of Patent: Mar. 7, 2017

(54) FLOW DISTRIBUTION ASSEMBLIES INCORPORATING SHUNT TUBES AND SCREENS AND METHOD OF USE

(71) Applicant: Halliburton Energy Services, Inc., Houston, TX (US)

(72) Inventors: Stephen Michael Greci, Little Elm, TX (US); Michael L. Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 175 days.

(21) Appl. No.: 14/406,127

(22) PCT Filed: Feb. 14, 2014

(86) PCT No.: PCT/US2014/016482
§ 371 (c)(1),
(2) Date: Dec. 5, 2014

(87) PCT Pub. No.: WO2015/122907
PCT Pub. Date: Aug. 20, 2015

(65) Prior Publication Data

US 2016/0265318 A1 Sep. 15, 2016

(51) Int. Cl.

| | |
|---|---|
| ***E21B 43/08*** | (2006.01) |
| ***E21B 17/18*** | (2006.01) |
| ***E21B 43/25*** | (2006.01) |
| *E21B 33/12* | (2006.01) |
| *E21B 34/00* | (2006.01) |

(52) U.S. Cl.
CPC ..... *E21B 43/08* (2013.01); *E21B 17/18* (2013.01); *E21B 43/25* (2013.01); *E21B 33/12* (2013.01); *E21B 2034/007* (2013.01)

(58) Field of Classification Search
CPC ..... E21B 43/08; E21B 43/088; E21B 43/086; E21B 17/18
See application file for complete search history.

(56) References Cited

U.S. PATENT DOCUMENTS

| | | | |
|---|---|---|---|
| 5,842,516 | A | 12/1998 | Jones |
| 7,426,962 | B2 | 9/2008 | Moen et al. |
| 8,240,374 | B2 | 8/2012 | Turick et al. |
| 2005/0028977 | A1 | 2/2005 | Ward |
| 2011/0030965 | A1 | 2/2011 | Coronado |

(Continued)

FOREIGN PATENT DOCUMENTS

| | | | |
|---|---|---|---|
| WO | 2015/122907 | A1 | 8/2015 |

OTHER PUBLICATIONS

International Search Report and Written Opinion for PCT/US2014/016482 dated Nov. 14, 2014.

*Primary Examiner* — Catherine Loikith
(74) *Attorney, Agent, or Firm* — McDermott Will & Emery LLP; Scott Richardson

(57) ABSTRACT

A flow distribution assembly includes one or more shunt tubes extending along an exterior of a base pipe that defines at least one flow port, the one or more shunt tubes being in fluid communication with the at least one flow port coupled to the one or more flow conduits and extending from the bulkhead along an exterior of the base pipe, and a plurality of shunt screens disposed on the one or more shunt tubes and having one or more openings defined therethrough, wherein the plurality of shunt screens facilitate fluid communication between the base pipe and an external environment.

21 Claims, 2 Drawing Sheets

(56) References Cited

U.S. PATENT DOCUMENTS

| | | | |
|---|---|---|---|
| 2011/0162840 | A1 | 7/2011 | Haeberle et al. |
| 2013/0112399 | A1 | 5/2013 | Royer et al. |
| 2013/0206394 | A1 | 8/2013 | Garcia et al. |

FLOW DISTRIBUTION ASSEMBLIES INCORPORATING SHUNT TUBES AND SCREENS AND METHOD OF USE

BACKGROUND

The present disclosure generally relates to downhole fluid flow control and, more particularly, to flow distribution assemblies used to distribute fluid flow into surrounding subterranean formations.

In the course of completing wellbores that traverse hydrocarbon-bearing portions of subterranean formations, it is oftentimes desirable to inject fluids into the wellbore for a number of purposes. For example, gases, such as steam, are often injected into surrounding formations in order to stimulate the production of high-viscosity hydrocarbons. In other applications, a treatment fluid, such as hydrochloric acid is injected into the wellbore to react with acid-soluble materials disposed in the formation, thereby enlarging pore spaces in the formation. In yet other applications, fluids, such as water or gas, may be injected into the surrounding formations in order to maintain formation pressures so that a producing well can continue production.

Injection operations are typically carried out by introducing an injection string into a wellbore to a desired location where fluid injection is desired. The injection string oftentimes includes a wellbore screen assembly that includes one or more sand screens arranged thereabout. The fluid injected into the surrounding formation must first pass through the sand screens, which serve to prevent the influx of sand or particulates back into the injection string during temporary breaks in the injection operation. Injection of the fluid typically occurs at high flow rates, which can lead to the erosion of vital portions of the sand screens at discrete exit points in the sand screens closest to the source of the fluid entrance point, such as a sliding sleeve within the injection tubing. Over time, fluid flow through the sand screens at these exit points can cause the sand screens to erode or otherwise degrade, and thereby render the filtering capabilities of the sand screen ineffective.

Moreover, following an injection operation, injection strings can optionally be used for production operations by reversing the flow of fluids and drawing fluids into the injection string from the surrounding formations. During such production operations, the sand screens, if undamaged, can be valuable in filtering sand, proppant, and any wellbore particulates of a certain size from being entrained into the injection tubing. However, similar to an injection operation, the influx of fluids also penetrates the sand screens at high flow rates and at discrete locations along the sand screens, such as at or near the sliding sleeves. If the sand screens are damaged, the high flow rate of incoming fluids again makes the sand screens susceptible to increased damage and erosion at vital portions during production operations.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure generally relates to downhole fluid flow control and, more particularly, to flow distribution assemblies used to distribute fluid flow into surrounding subterranean formations.

The presently disclosed embodiments enable relatively high rates of fluid flow through a flow distribution assembly during injection and production operations. As opposed to using wire wrap or mesh-style sand screens, which are susceptible to fluid flow erosion, degradation, and possible failure, the flow distribution assemblies described herein include shunt tubes that extend along the exterior of base pipe to allow for fluid communication. The shunt tubes are less susceptible to erosion than conventional sand screens. More particularly, in injection operations, the shunt tubes may convey fluids from the base pipe to various fluid flow points so that the fluid can be evenly distributed as it is injected into a surrounding subterranean formation. The fluid flow points provided in the shunt tubes may each include a shunt screen made of an erosion-resistant material and configured to filter fluid streams such that particulates, sand, and/or other fines found within the wellbore are prevented from entering the shunt tubes and, therefore, entering the base pipe.

Figure 1:
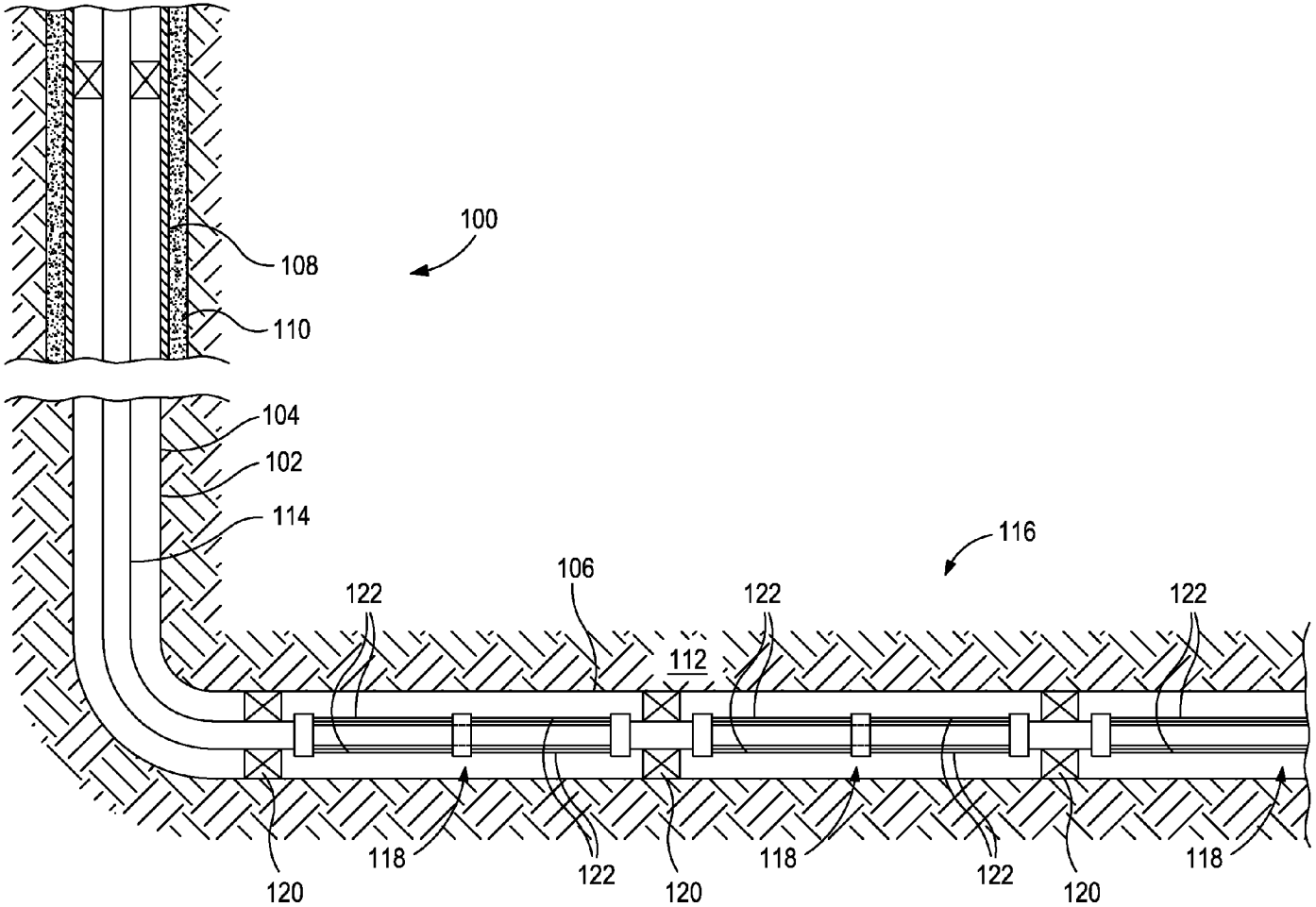
FIG. 1 illustrates an exemplary well system that can employ one or more principles of the present disclosure, according to one or more embodiments.

Referring to FIG. 1, illustrated is an exemplary well system 100 that can employ one or more principles of the present disclosure, according to one or more embodiments. As depicted, the well system 100 includes a wellbore 102 that extends through various earth strata and may have a substantially vertical section 104 that may transition into a substantially horizontal section 106. The upper portion of the vertical section 104 may have a liner or casing string 108 secured therein with, for example, cement 110. The horizontal section 106 may extend through a hydrocarbon bearing subterranean formation 112. As illustrated, the horizontal section 106 may be arranged within or otherwise extend through an open hole section of the wellbore 102. In other embodiments, however, the horizontal section 106 of the wellbore 102 may also be completed using casing 108 or the like, without departing from the scope of the disclosure.

A tubing string 114 may be positioned within the wellbore 102 and extend from the surface (not shown). The tubing string 114 provides a conduit for fluids to be conveyed either to or from the formation 112. Accordingly, the tubing string 114 may be characterized as an injection string in embodiments where fluids are introduced or otherwise conveyed to the formation 112, but may alternatively be characterized as production tubing in embodiments where fluids are extracted from the formation 112 to be conveyed to the surface.

At its lower end, the tubing string 114 may be coupled to or otherwise form part of a completion assembly 116 generally arranged within the horizontal section 106. When installed within the wellbore 102, the completion assembly 116 serves to divide the completion interval into various production intervals or zones adjacent the formation 112 of interest. As depicted, the completion assembly 116 may include a plurality of flow distribution assemblies 118 axially offset from each other along portions of the completion assembly 116. Each flow distribution assembly 118 may be positioned between a pair of wellbore isolation devices or packers 120. The packers 120 may be configured to provide a fluid seal between discrete portions of the completion assembly 116 and the wellbore 102, thereby defining corresponding production intervals.

As opposed to using wire wrap or mesh-style sand screens, which are susceptible to fluid flow erosion, the flow distribution assemblies 118 may include shunt tubes 122 that extend along the exterior of the tubing string 114. In injection operations, the shunt tubes 122 may be configured to convey fluids from the tubing string 114 to various fluid flow points along the shunt tubes 122 so that the fluid can be evenly distributed as it is injected into the surrounding formation 112. Similarly, in production operations, fluid from the surrounding formation 112 may be drawn into the shunt tubes 122 at the various fluid flow points and conveyed to the interior of the tubing string 114 via the shunt tubes 122 to be produced to the surface. As described in more detail below, the fluid flow points provided in the shunt tubes 122 may each include a shunt screen (not shown). The shunt screens associated with the shunt tubes 122 may be made of erosion-resistant materials and configured to filter fluid streams such that particulates, sand, and/or other fines found within the wellbore 102 are prevented from entering the shunt tubes 122 and, therefore, entering the tubing string 114.

It should be noted that even though FIG. 1 depicts the flow distribution assemblies 118 as being arranged in an open hole portion of the wellbore 102, alternative embodiments are contemplated herein where one or more of the flow distribution assemblies 118 is arranged within cased portions of the wellbore 102. Also, even though FIG. 1 depicts multiple completion intervals separated by the packers 120, it will be understood by those skilled in the art that the completion interval may include any number of production intervals or zones (including only a single interval) with a corresponding number of packers 120 arranged therein. In other embodiments, the packers 120 may be entirely omitted from the completion interval, without departing from the scope of the disclosure.

Further, even though FIG. 1 depicts the flow distribution assemblies 118 as being arranged in the horizontal section 106 of the wellbore 102, those skilled in the art will readily recognize that the principles of the present disclosure are equally well suited for use in vertical wells, deviated wellbores, slanted wells, multilateral wells, combinations thereof, and the like. As used herein, directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
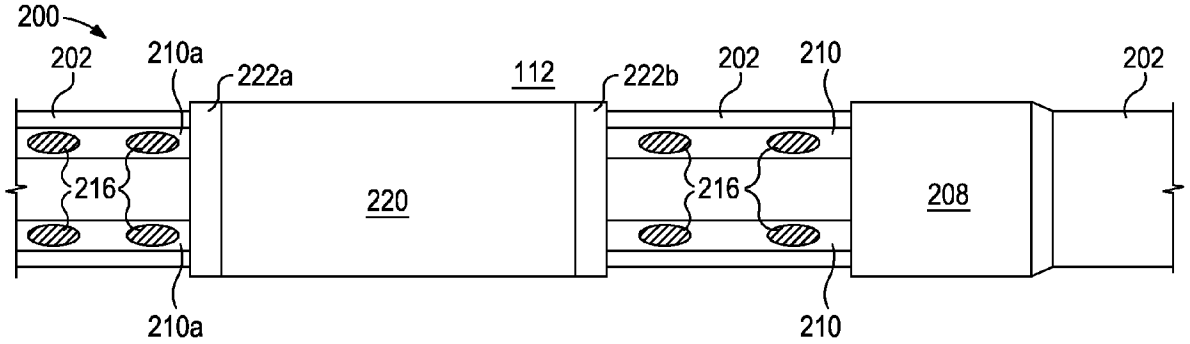
FIG. 2 illustrates a top view of an exemplary flow distribution assembly, according to one or more embodiments.
Figure 3:
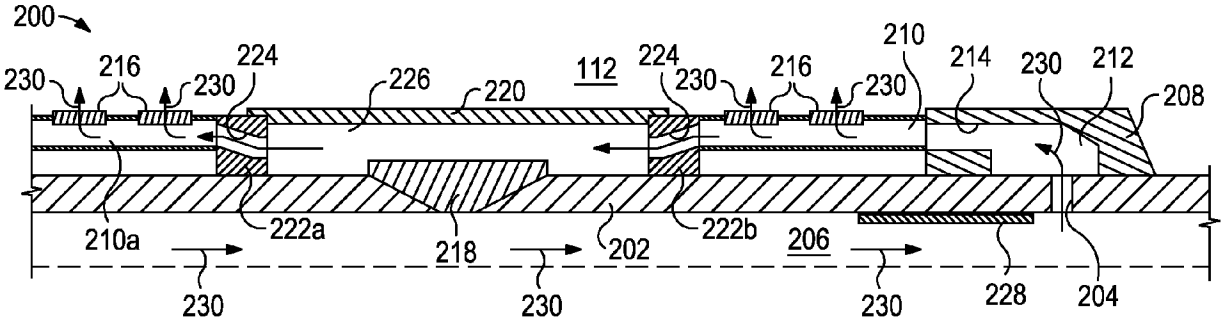
FIG. 3 illustrates a partial cross-sectional side view of the flow distribution assembly of FIG. 2, according to one or more embodiments.

Referring now to FIGS. 2 and 3, with continued reference to FIG. 1, illustrated are enlarged top and partial cross-sectional side views, respectively, of an exemplary flow distribution assembly 200, according to one or more embodiments. The flow distribution assembly 200 (hereafter "assembly 200") may replace one or more of the flow distribution assemblies 118 described above with reference to FIG. 1, and may otherwise be used in the exemplary well system 100. As illustrated, the assembly 200 may be arranged about a base pipe 202, which may be or otherwise form part of the tubing string 114 of FIG. 1. As best seen in FIG. 3, the base pipe 202 may define one or more openings or flow ports 204 (one shown) configured to provide fluid communication between an interior 206 of the base pipe 202 and the surrounding subterranean formation 112. While only one flow port 204 is depicted in FIG. 3, it will be appreciated that more than one flow port 204 may be provided in the base pipe 202, without departing from the scope of the disclosure.

The assembly 200 may include a bulkhead 208 and a plurality of channels or shunt tubes 210 that extend axially from the bulkhead 208 along the exterior of the base pipe 202. The bulkhead 208 may be arranged or otherwise disposed about the exterior of the base pipe 202 and may be formed from a metal, such as 13 chrome, 304L stainless steel, 316L stainless steel, 420 stainless steel, 410 stainless steel, Incoloy 825, iron, brass, copper, bronze, tungsten, titanium, cobalt, nickel, combinations thereof, or the like. Moreover, the bulkhead 208 may be coupled or otherwise attached to the outer surface of base pipe 202 by being welded, brazed, threaded, mechanically fastened, shrink-fitted, or any combination thereof.

The bulkhead 208 may further define a flow chamber 212. In some embodiments, the flow chamber 212 may be configured to receive fluids from the interior 206 of the base pipe 202 via the flow port 204 to be injected into the surrounding formation 112. In other embodiments, however, the flow chamber 212 may be configured to receive fluids from the surrounding formation 112 to be conveyed into the base pipe 202 during production operations. While not shown, the bulkhead 208 may further include additional structural components such as shrouds (e.g., sleeves) or rings (e.g., a crimp ring or shrink ring) that help facilitate the construction of the assembly 200. In at least one embodiment, for instance, a shroud or sleeve may be attached (i.e., threaded, welded, mechanically fastened, etc.) to the bulkhead 208 and substantially define the flow chamber 212, without departing from the scope of the disclosure.

In order to prevent or otherwise reduce erosion during long-term operation, the interior of the flow chamber 212 may be made of or otherwise cladded with an erosion-resistant material. In some embodiments, for example, the bulkhead 208 itself, which defines the flow chamber 212, may be made of an erosion-resistant material. In other embodiments, however, the inner walls of the flow chamber 212 may be cladded with the erosion-resistant material. The erosion-resistant material may be, but is not limited to, a carbide (e.g., tungsten, titanium, tantalum, or vanadium), a carbide embedded in a matrix of cobalt or nickel by sintering, a ceramic, a surface hardened metal (e.g., nitrided metals, heat-treated metals, carburized metals, etc.), or any combination thereof.

The shunt tubes 210 may be similar to the shunt tubes 122 of FIG. 1 and otherwise may replace the shunt tubes 122. The shunt tubes 210 may be generally tubular members that provide a fluid conduit or passageway for delivering fluids to/from the interior 206 of the base pipe 202. More particularly, each shunt tube 210 may be fluidly coupled to the bulkhead 208 and placed in fluid communication with the interior 206 of the base pipe 202 via the flow chamber 212 and the flow port 204. In some embodiments, each shunt tube 210 may be directly coupled to the flow chamber 212. In other embodiments, however, each shunt tube 210 may be fluidly coupled to a corresponding flow conduit 214 defined axially through the bulkhead 208 and in fluid communication with the flow chamber 212. The shunt tubes 210 may be fluidly coupled to the flow conduits 214 in a variety of ways including, but not limited to, welding, brazing, threading, mechanically fastening, shrink fitting, or any combination thereof. In at least one embodiment, the shunt tubes 210 may be extended at least partially into the flow conduits 214 in order to be secured to the bulkhead 208.

In the illustrated embodiment, the shunt tubes 210 are depicted as having a generally cylindrical or circular cross-sectional shape. In other embodiments, however, one or more of the shunt tubes 210 may have a polygonal cross-section, such as triangular, rectangular, square, trapezoidal, or any other polygonal shape. In yet other embodiments, one or more of the shunt tubes 210 may exhibit a cross-sectional shape that is substantially oval or kidney shaped, without departing from the scope of the disclosure.

Similar to the flow chamber 212, the shunt tubes 210 may also be configured to be erosion-resistant or otherwise made of an erosion-resistant material. For instance, the shunt tubes 210 may be made of a carbide or a ceramic. In other embodiments, the shunt tubes 210 may be made of a metal or other material that is internally cladded with an erosion-resistant material such as, but not limited to, tungsten carbide or ceramic. In yet other embodiments, the shunt tubes 210 may be made of a material that has been surface hardened, such as surface hardened metals (e.g., via nitriding), heat treated metals (e.g., using 13 chrome), carburized metals, or the like. In even further embodiments, one or more of the shunt tubes 210, or a portion thereof, may be an Aramid-type fiber tube, such as a Kevlar or other type of composite.

While only two shunt tubes 210 are depicted in FIG. 2 as coupled to and otherwise extending from the bulkhead 208, it will be appreciated that more or less than two shunt tubes 210 may be employed in the assembly 200. In at least one embodiment, for instance, four shunt tubes 210 may be equidistantly (or non-equidistantly) spaced about the circumference of the base pipe 202 and each configured to extend axially from the bulkhead 208. The number of shunt tubes 210 may be determined based on the amount of fluid flow desired to be injected into the surrounding formation 112.

The assembly 200 may further include a plurality of shunt screens 216 disposed on or otherwise attached to the shunt tubes 210 at various predetermined points. The shunt screens 216 may be coupled or otherwise attached to the shunt tubes 210 in various ways such as, but not limited to, welding, brazing, threading, mechanically fastening, shrink fitting, or any combination thereof. The shunt screens 216 may be configured to facilitate fluid communication between the surrounding formation 112 and the interior of the shunt tubes 210. In order to prevent or otherwise reduce erosion to the shunt screens during operation, the shunt screens 216 may be made of or otherwise clad with an erosion-resistant material, such as any of the erosion-resistant materials discussed herein above (e.g., carbides, ceramics, surface hardened metals, etc.).

As illustrated, the shunt screens 216 may be disk-like structures that may be circular or oval. In other embodiments, one or more of the shunt screens 216 may exhibit a generally polygonal shape, such as square, rectangular, or trapezoidal, without departing from the scope of the disclosure. In yet other embodiments, one or more of the shunt screens 216 may be integral to or otherwise form part of the corresponding shunt tube 210, without departing from the scope of the disclosure. As will be appreciated, the given shape of each shunt screen 216 may be selected from a variety of other shapes not mentioned herein and equally operate as described herein.

Each shunt screen 216 may be strategically placed at predetermined locations along the axial length of the shunt tubes 210 in order to inject (or produce) fluids at desired locations with respect to the surrounding formation 112. In some embodiments, the shunt screens 216 may provide or otherwise define one or more openings, holes, or cuts that extend through the disk structure in order to allow fluid communication therethrough. In the illustrated embodiment, the openings through the shunt screens 216 may be in the form of a series of slots or the like. In other embodiments, however, one or more shunt screens 216 may provide or otherwise define a plurality of circular holes or perforations that equally allow fluid flow therethrough. As will be appreciated, the shunt screens 216 may provide or define any shape of perforation or opening in order to facilitate fluid communication between the surrounding formation 112 and the interior of the associated shunt tube 210, without departing from the scope of the disclosure. In other embodiments, the shunt screens 216 may be a porous erosion-resistant media, or the openings defined in the shunt screens 216 may otherwise be filled with the porous erosion-resistant media.

In some embodiments, the shunt screens 216 may be arranged on the shunt tubes 210 so that fluids may be evenly distributed into the surrounding formation 112 during injection operations. In one embodiment, for example, this may be accomplished by having a lesser number of shunt screens 216 used closer to the bulkhead 208 and progressively increasing the number of shunt screens 216 away from the bulkhead 208. Even distribution of fluids into the surrounding formation 112 may equally be accomplished by selectively sizing the slots or openings in the shunt screens 216 so that predetermined amounts of fluid flow therethrough is allowed. For instance, smaller slots or openings may be desirable in shunt screens 216 that are located closer to the bulkhead 208, while larger slots or openings may be desirable in shunt screens 216 that are located further from the bulkhead 208. Accordingly, the shunt screens 216 may be used as flow restrictors or flow control devices that balance the flow of fluid through the shunt tubes 210 and otherwise to the formation 112.

In some embodiments, as illustrated, the shunt tubes 210 may extend along the exterior of the base pipe 202 until locating a pipe joint 218 (FIG. 3) that connects upper and lower portions of the base pipe 202. In at least one embodiment, the assembly 200 may include a pipe joint sleeve 220 arranged about the pipe joint 218 and configured to fluidly couple the shunt tubes 210 to additional shunt tubes 210*a* that axially extend further uphole from the pipe joint sleeve 220. More particularly, the pipe joint sleeve 220 may be coupled or otherwise attached to upper and lower end rings 222*a* and 222*b* arranged about the upper and lower portions of the base pipe 202, respectively. The pipe joint sleeve 220 may be coupled to one or both of the upper and lower end rings 222*a,b* in various ways such as, but not limited to, welding, brazing, threading, mechanically fastening, shrink fitting, or any combination thereof.

The shunt tubes 210 extending from the bulkhead 208 may be fluidly coupled to the lower end ring 222*b*. In some embodiments, for example, each shunt tube 210 may be fluidly coupled to a corresponding flow passageway 224 defined through the lower end ring 222*b*. A sleeve chamber 226 may be defined between the pipe joint sleeve 220 and the base pipe 202 (i.e., the pipe joint 218) and may be in fluid communication with the shunt tubes 210 via the flow passageways 224. The additional shunt tubes 210*a* may be fluidly coupled to the upper end ring 222*a* and axially extend uphole therefrom. Similar to the lower end ring 222*b*, for instance, the upper end ring 222*a* may also provide one or more flow passageways 224 defined therethrough and the additional shunt tubes 210*a* may be fluidly coupled thereto in order to place the sleeve chamber 226 in fluid communication with the additional shunt tubes 210*a*.

As will be appreciated, the pipe joint sleeve 220 may prove advantageous in creating a fluid pathway across the pipe joint 218 that fluidly couples the shunt tubes 210 and the additional shunt tubes 210*a* via the sleeve chamber 226 (i.e., through the flow passageways 224 of the upper and lower end rings 222*a,b*). The pipe joint sleeve 220, therefore, may eliminate the need for timed threads in the base pipe 202 at the pipe joint 218. In other embodiments, however, the shunt tubes 210 and the additional shunt tubes 210*a* may alternatively be placed in fluid communication via other structural members, such as corresponding jumper tubes (not shown), that extend across the pipe joint 218 and otherwise fluidly communicate the shunt tubes 210 to the additional shunt tubes 210*a*.

As illustrated, the additional shunt tubes 210*a* may also include one or more shunt screens 216. As a result, the additional shunt tubes 210*a* and their associated shunt screens 216 may facilitate fluid communication between the interior of the additional shunt tubes 210*a* and the surrounding formation 112.

In one or more embodiments, a sleeve 228 may optionally be arranged within the base pipe 206 and movable between open and closed positions. In the closed position, the sleeve 228 occludes the flow port 204, and in the open position the sleeve 228 is moved to expose the flow port 204. The sleeve 228 may be actuatable between the open and closed positions using any type of actuator such as, but not limited to, a mechanical actuator, an electric actuator, an electromechanical actuator, a hydraulic actuator, a pneumatic actuator, or any combination thereof. In other embodiments, the sleeve 228 may be configured to move between closed and open positions by being acted upon by one or more wellbore projectiles, such as wellbore darts or balls. In yet other embodiments, the sleeve 228 may be triggered to move between closed and open positions by assuming a pressure differential within the interior 206 of the base pipe 202.

In exemplary operation, and with particular reference to FIG. 3, a fluid 230 may be conveyed or pumped to the location of the assembly 200 within the interior 206 of the base pipe 202. In the present embodiment, the fluid 230 may be any fluid used for a wellbore injection operation including, but not limited to, water (e.g., fresh water, saltwater, brine, etc.), gases (e.g., $CO_2$, air, steam, etc.), a formation fluid, an acidizing fluid, a wellbore treatment fluid, and/or acids (or other wellbore treatment fluids). Upon encountering the assembly 200, the sleeve 228 may be moved to the open position to allow the fluid 230 to enter the flow chamber 212 via the flow port 204 and subsequently flow into the shunt tubes 210.

The shunt tubes 210 may then be configured to convey the fluid 230 to the various positions of the shunt screens 216 where the fluid 230 is able to exit or flow through the shunt tubes 210 and otherwise be injected into the surrounding formation 112. In some embodiments, a portion of the fluid 230 may also be conveyed to the additional shunt tubes 210*a* via the sleeve chamber 226 and the associated flow passageways 224 defined in the upper and lower end rings 222*a,b*. The additional shunt tubes 210*a* may be configured to convey the fluid 230 to the various shunt screens 216 where the fluid is able to escape the additional shunt tubes 210 and be injected into the surrounding formation 112. In some embodiments, injection of the fluid 230 into the formation 112 may be undertaken in an effort to maintain formation pressures so that a producing well can efficiently continue production. It will be appreciated that injection pressures of the currently disclosed embodiments are not limited to any pressure limit.

In some embodiments, the shunt screens 216 in all or a portion of the shunt tubes 210 extending from the bulkhead 208 may be omitted and the shunt tubes 210 may otherwise provide substantially sealed conduits leading to the sleeve chamber 236. As a result, the fluid 230 may be substantially conveyed to the additional shunt tubes 210*a* and otherwise able to be conveyed long distances away from the bulkhead 208 to be selectively injected into the formation 112 at predetermined locations distal to the bulkhead 208. In at least one embodiment, the shunt screens 216 may be omitted over predetermined lengths or locations of the shunt tubes 210, 210*a* in order to selectively inject the fluid 230 into corresponding predetermined portions of the surrounding formation 112. Accordingly, the assembly 200 may prove advantageous in distributing the flow of the fluid 230 through the shunt tubes 210, 210*a* such that the fluid 230 is injected into the surrounding formation 112 over potentially long distances and otherwise in selected locations.

In other embodiments, the additional shunt tubes 210*a* extending from the pipe joint sleeve 220 may be replaced with a traditional screen assembly (not shown), such as a wire wrap or weave screen assembly. More particularly, a screen assembly may be fluidly coupled to the sleeve chamber 236 and otherwise configured to receive the fluid 230 flowing therethrough from the shunt tubes 210 extending from the bulkhead 208. The shunt tubes 210 extending from the bulkhead 208 may prove useful in abating or otherwise reducing the high velocity flow of the fluid 230 initially introduced into the assembly 200 at the bulkhead 208. By the time the fluid 230 reaches the screen assembly where the additional shunt tubes 210*a* would otherwise be arranged, the flow velocity of the fluid 230 may be reduced to a level that is less likely to erode the screen(s).

While the foregoing operation of the assembly 200 is generally described above with reference to injection operations, where a fluid 230 (FIG. 2) is injected into the surrounding formation 112 via the shunt tubes 210, 210*a* and associated shunt screens 216, those skilled in the art will readily appreciate that the assembly 200 may equally be used in production operations (e.g., reverse-flow operations), without departing from the scope of the disclosure. For example, in other embodiments, the flow of another fluid (not shown), such as a formation fluid, may instead be drawn into the shunt tubes 210, 210*a* via the shunt screens 216 and subsequently into the interior 206 of the base pipe 202 to be produced to the surface. The slots or openings in the shunt screens 216 may be sized to prevent debris or other particulate matter (e.g., gravel, proppant, etc.) of a predetermined size to pass therethrough and otherwise be produced to the surface. As will be appreciated, the size or dimensions of the slots or openings in the shunt screens 216 may be varied depending on the size of the given particulate matter that is to be prevented from being produced. Advantageously, the erosion-resistant characteristics of the shunt tubes 210, 210*a* and the shunt screens 216 allow the fluids to be produced without eroding the debris filtering capabilities of the assembly 200.

Embodiments disclosed herein include:

A. A flow distribution assembly that includes one or more shunt tubes extending along an exterior of a base pipe that defines at least one flow port, the one or more shunt tubes being in fluid communication with the at least one flow port, and a plurality of shunt screens disposed on the one or more shunt tubes and having one or more openings defined therethrough, wherein the plurality of shunt screens facilitate fluid communication between the base pipe and an external environment.

B. A method that includes introducing a flow distribution assembly into a wellbore that penetrates a subterranean formation, the flow distribution assembly being arranged on a base pipe and comprising, one or more shunt tubes extending along an exterior of the base pipe and in fluid communication with at least one flow port defined in the base pipe, and a plurality of shunt screens disposed on the one or more shunt tubes and having one or more openings defined therethrough, pumping a fluid to the flow distribution assembly within an interior of the base pipe, conveying the fluid into the one or more shunt tubes via the at least one flow port, and ejecting the fluid into the subterranean formation through the plurality of shunt screens.

Each of embodiments A and B may have one or more of the following additional elements in any combination: Element 1: a bulkhead arranged about the base pipe and having one or more flow conduits defined therein and in fluid communication with the at least one flow port, the one or more shunt tubes being fluidly coupled to the one or more flow conduits and extending from the bulkhead, and a flow chamber defined in the bulkhead and in fluid communication with the at least one flow port and the one or more shunt tubes. Element 2: wherein the flow chamber is cladded with an erosion-resistant material selected from the group consisting of a carbide and a ceramic. Element 3: wherein a cross-sectional shape of the one or more shunt tubes is at least one of circular, polygonal, oval, and kidney-shaped. Element 4: wherein at least one of the plurality of shunt screens comprises an erosion-resistant material selected from the group consisting of a carbide, a ceramic, and a surface-hardened metal. Element 5: wherein at least one of the plurality of shunt screens is cladded with an erosion-resistant material selected from the group consisting of a carbide and a ceramic. Element 6: wherein the one or more openings comprises a plurality of slots defined in at least one of the plurality of shunt screens. Element 7: wherein the external environment is a subterranean formation. Element 8: wherein the base pipe has upper and lower portions coupled at a pipe joint, the flow distribution assembly further comprising upper and lower end rings arranged about the upper and lower portions of the base pipe, respectively, a pipe joint sleeve arranged about the base pipe at the pipe joint and coupled to the upper and lower end rings such that a sleeve chamber is defined therebetween, wherein the one or more shunt tubes is fluidly coupled to the sleeve chamber via the lower end ring, one or more additional shunt tubes fluidly coupled to the sleeve chamber via the upper end ring and extending from the pipe joint sleeve along the exterior of the base pipe, and one or more additional shunt screens disposed on the one or more additional shunt tubes and having one or more openings defined therethrough to facilitate fluid communication between the base pipe and the external environment. Element 9: wherein the shape of the plurality of shunt screens is at least one of oval, circular, polygonal, and kidney-shaped.

Element 10: wherein the fluid is at least one of water, a gas, or an acid. Element 11: wherein conveying the fluid into the one or more shunt tubes via the at least one flow port is preceded by moving a sleeve arranged within the base pipe from a closed position, where the sleeve occludes the at least one flow port, to an open position, where the at least one flow port is exposed. Element 12: further comprising maintaining a formation pressure within the subterranean formation with the fluid. Element 13: wherein the fluid is a first fluid and the method further comprises drawing a second fluid into the one or more shunt tubes via the plurality of shunt screens, the second fluid being derived from the subterranean formation, and conveying the second fluid into the interior of the base pipe via the at least one flow port. Element 14: wherein the flow distribution assembly further includes a bulkhead arranged about the base pipe and having a plurality of flow conduits defined therein and in fluid communication with at least one flow port defined in the base pipe, and wherein conveying the fluid into the one or more shunt tubes via the at least one flow port comprises flowing the fluid through a flow chamber defined in the bulkhead and in fluid communication with the at least one flow port and the one or more shunt tubes. Element 15: further comprising preventing erosion of the flow chamber with an erosion-resistant material cladded to an interior surface of the flow chamber, the erosion-resistant material being selected from the group consisting of a carbide and a ceramic. Element 16: further comprising preventing erosion of at least one of the plurality of shunt screens by cladding the at least one of the plurality of shunt screens with an erosion-resistant material selected from the group consisting of a carbide and a ceramic. Element 17: further comprising preventing erosion of at least one of the plurality of shunt screens by manufacturing the at least one of the plurality of shunt screens out of an erosion-resistant material selected from the group consisting of a carbide, a ceramic, and a surface-hardened metal. Element 18: wherein the base pipe has upper and lower portions coupled at a pipe joint, upper and lower end rings arranged about the upper and lower portions of the base pipe, respectively, and a pipe joint sleeve arranged about the base pipe at the pipe joint and coupled to the upper and lower end rings such that a sleeve chamber is defined therebetween, the method further comprising flowing the fluid to the sleeve chamber via the one or more shunt tubes, the one or more shunt tubes being fluidly coupled to the sleeve chamber via the lower end ring, conveying the fluid into one or more additional shunt tubes fluidly coupled to the sleeve chamber via the upper end ring and extending from the pipe joint sleeve along the exterior of the base pipe, wherein one or more additional shunt screens are disposed on the one or more additional shunt tubes and have one or more openings defined therethrough, and ejecting the fluid into the subterranean formation through the plurality of shunt screens disposed on the one or more additional shunt tubes. Element 19: wherein the base pipe has upper and lower portions coupled at a pipe joint, upper and lower end rings arranged about the upper and lower portions of the base pipe, respectively, and a pipe joint sleeve arranged about the base pipe at the pipe joint and coupled to the upper and lower end rings such that a sleeve chamber is defined therebetween, the method further comprising flowing the fluid to the sleeve chamber via the one or more shunt tubes, the one or more shunt tubes being fluidly coupled to the sleeve chamber via the lower end ring, conveying the fluid into a wire wrap screen assembly fluidly coupled to the sleeve chamber via the upper end ring and extending from the pipe joint sleeve along the exterior of the base pipe, and ejecting the fluid into the subterranean formation through the wire wrap screen assembly.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Further-more, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A flow distribution assembly, comprising:

one or more shunt tubes extending along an exterior of a base pipe that defines at least one flow port, the one or more shunt tubes being in fluid communication with the at least one flow port via a bulkhead arranged about the base pipe; and a plurality of shunt screens disposed on the one or more shunt tubes and having one or more openings defined therethrough to facilitate fluid communication between the base pipe and an external environment via the one or more shunt tubes.

2. The flow distribution assembly of claim 1, further comprising:

at least one flow conduit defined in the bulkhead and in fluid communication with the at least one flow port, the one or more shunt tubes being fluidly coupled to the one or more flow conduits and extending from the bulkhead; and a flow chamber defined in the bulkhead and in fluid communication with the at least one flow port and the one or more shunt tubes.

3. The flow distribution assembly of claim 2, wherein the flow chamber is cladded with an erosion-resistant material selected from the group consisting of a carbide and a ceramic.

4. The flow distribution assembly of claim 1, wherein a cross-sectional shape of the one or more shunt tubes is selected from the group consisting of circular, polygonal, oval, and kidney-shaped.

5. The flow distribution assembly of claim 1, wherein at least one of the plurality of shunt screens comprises an erosion-resistant material selected from the group consisting of a carbide, a ceramic, and a surface-hardened metal.

6. The flow distribution assembly of claim 1, wherein at least one of the plurality of shunt screens is cladded with an erosion-resistant material selected from the group consisting of a carbide and a ceramic.

7. The flow distribution assembly of claim 1, wherein the one or more openings comprises a plurality of slots defined in at least one of the plurality of shunt screens.

8. The flow distribution assembly of claim 1, wherein the external environment is a subterranean formation.

9. The flow distribution assembly of claim 1, wherein the base pipe has upper and lower portions coupled at a pipe joint, the flow distribution assembly further comprising:

upper and lower end rings arranged about the upper and lower portions of the base pipe, respectively;

a pipe joint sleeve arranged about the base pipe at the pipe joint and coupled to the upper and lower end rings such that a sleeve chamber is defined therebetween, wherein the one or more shunt tubes is fluidly coupled to the sleeve chamber via the lower end ring;

one or more additional shunt tubes fluidly coupled to the sleeve chamber via the upper end ring and extending from the pipe joint sleeve along the exterior of the base pipe; and one or more additional shunt screens disposed on the one or more additional shunt tubes and having one or more openings defined therethrough to facilitate fluid communication between the base pipe and the external environment.

10. The flow distribution assembly of claim 1, wherein a cross-sectional shape of the plurality of shunt screens is selected from the group consisting of oval, circular, polygonal, and kidney-shaped.

11. A method, comprising:

introducing a flow distribution assembly into a wellbore that penetrates a subterranean formation, the flow distribution assembly being arranged on a base pipe and comprising:

one or more shunt tubes extending along an exterior of the base pipe and in fluid communication with at least one flow port defined in the base pipe via a bulkhead arranged about the base pipe; and a plurality of shunt screens disposed on the one or more shunt tubes and having one or more openings defined therethrough;

conveying a fluid to the flow distribution assembly within an interior of the base pipe;

conveying the fluid into the one or more shunt tubes via the at least one flow port and the bulkhead; and injecting the fluid into the subterranean formation through the plurality of shunt screens.

12. The method of claim 11, wherein the fluid comprises a fluid selected from the group consisting of water, a gas, a formation fluid, an acidizing fluid, a wellbore treatment fluid, an acid, and any combination thereof.

13. The method of claim 11, wherein conveying the fluid into the one or more shunt tubes via the at least one flow port is preceded by moving a sleeve arranged within the base pipe from a closed position to an open position.

14. The method of claim 11, further comprising maintaining a formation pressure within the subterranean formation with the fluid, the formation pressure being sufficient for production operations.

15. The method of claim 11, wherein the fluid is a first fluid and the method further comprises:

drawing a second fluid into the one or more shunt tubes via the plurality of shunt screens, the second fluid being derived from the subterranean formation; and conveying the second fluid into the interior of the base pipe via the at least one flow port.

16. The method of claim 11, wherein the flow distribution assembly further includes at least one flow conduit defined in the bulkhead and in fluid communication with at least one flow port, and wherein conveying the fluid into the one or more shunt tubes via the at least one flow port comprises flowing the fluid through a flow chamber defined in the bulkhead and in fluid communication with the at least one flow port and the one or more shunt tubes.

17. The method of claim 16, further comprising preventing erosion of the flow chamber with an erosion-resistant material cladded to an interior surface of the flow chamber, the erosion-resistant material being selected from the group consisting of a carbide and a ceramic.

18. The method of claim 11, further comprising preventing erosion of at least one of the plurality of shunt screens by cladding the at least one of the plurality of shunt screens with an erosion-resistant material selected from the group consisting of a carbide and a ceramic.

19. The method of claim 11, further comprising preventing erosion of at least one of the plurality of shunt screens by manufacturing the at least one of the plurality of shunt screens out of an erosion-resistant material selected from the group consisting of a carbide, a ceramic, and a surface-hardened metal.

20. The method of claim 11, wherein the base pipe has upper and lower portions coupled at a pipe joint, upper and lower end rings arranged about the upper and lower portions of the base pipe, respectively, and a pipe joint sleeve arranged about the base pipe at the pipe joint and coupled to the upper and lower end rings such that a sleeve chamber is defined therebetween, the method further comprising:

flowing the fluid to the sleeve chamber via the one or more shunt tubes, the one or more shunt tubes being fluidly coupled to the sleeve chamber via the lower end ring;

conveying the fluid into one or more additional shunt tubes fluidly coupled to the sleeve chamber via the upper end ring and extending from the pipe joint sleeve along the exterior of the base pipe, wherein one or more additional shunt screens are disposed on the one or more additional shunt tubes and have one or more openings defined therethrough; and ejecting the fluid into the subterranean formation through the plurality of shunt screens disposed on the one or more additional shunt tubes.

21. The method of claim 11, wherein the base pipe has upper and lower portions coupled at a pipe joint, upper and lower end rings arranged about the upper and lower portions of the base pipe, respectively, and a pipe joint sleeve arranged about the base pipe at the pipe joint and coupled to the upper and lower end rings such that a sleeve chamber is defined therebetween, the method further comprising:

flowing the fluid to the sleeve chamber via the one or more shunt tubes, the one or more shunt tubes being fluidly coupled to the sleeve chamber via the lower end ring;

conveying the fluid into a wire wrap screen assembly fluidly coupled to the sleeve chamber via the upper end ring and extending from the pipe joint sleeve along the exterior of the base pipe; and injecting the fluid into the subterranean formation through the wire wrap screen assembly.

* * * * *